US007419128B1

(12) United States Patent
Bruck et al.

(10) Patent No.: US 7,419,128 B1
(45) Date of Patent: Sep. 2, 2008

(54) PIPE MOUNTING APPARATUS AND METHOD OF USE

(75) Inventors: Michael Raymond Bruck, Morrilton, AR (US); Patrick Stuart Mullins, Russellville, AR (US)

(73) Assignee: Intencity Lighting, Inc., Dardanelle, AR (US)

( * ) Notice: Subject to any disclaimer, the term of this patent is extended or adjusted under 35 U.S.C. 154(b) by 0 days.

(21) Appl. No.: 11/519,471

(22) Filed: Sep. 12, 2006

Related U.S. Application Data

(60) Provisional application No. 60/716,206, filed on Sep. 12, 2005.

(51) Int. Cl.
*B42F 13/00* (2006.01)

(52) U.S. Cl. ..... 248/342; 248/343

(58) Field of Classification Search ..... 248/58, 248/59, 61, 62, 343, 342, 344; 362/382, 362/147, 457, 393
See application file for complete search history.

(56) References Cited

U.S. PATENT DOCUMENTS

| | | | | |
|---|---|---|---|---|
| 3,022,034 | A * | 2/1962 | Purdy | 248/342 |
| 3,639,752 | A * | 2/1972 | Appleton | 174/61 |
| 6,669,158 | B2 * | 12/2003 | Masas | 248/317 |
| 2004/0108419 | A1 * | 6/2004 | Sono | 248/63 |

* cited by examiner

*Primary Examiner*—Amy J. Sterling
(74) *Attorney, Agent, or Firm*—Mind Law Firm; Jeromye V. Sartain

(57) ABSTRACT

An internally expanding and locking apparatus for installing inside the pipe stub of a typical outdoor lighting pole and expanding with locking teeth to grasp the inner walls of the pipe stub, the apparatus including a swivel base, a clamp screw inserted through the swivel base, a ramp nut passing over the clamp screw so as to be positioned offset from the swivel base, and a mounting nut threadably installed on the clamp screw and configured to engage the ramp nut so as to control the position of the ramp nut relative to the swivel base as the clamp screw is rotated during use of the pipe mounting apparatus.

15 Claims, 2 Drawing Sheets

PIPE MOUNTING APPARATUS AND METHOD OF USE

RELATED APPLICATIONS

This application claims priority and is entitled to the filing date of U.S. Provisional application Ser. No. 60/716,206 filed Sep. 12, 2005, and entitled "Luminaire Mounting System with Single Tightener." The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to an apparatus and method for mounting a device to a pole or other structure having an existing pipe stub, and more particularly to such an apparatus and method for attaching luminaries to new or existing poles for particular lighting applications.

2. Description of Related Art

Pre-existing light poles or other supports and the pipes or pipe stubs extending therefrom on which a particular luminaire mounting is to be attached are known in the art to have varying diameters, varying pipe wall thickness and varying materials such as steel or aluminum. Each pipe may also have a different surface coating, such as zinc, paint, powder coat, and anodizing or natural corrosion. In the case of an outdoor lighting application, the mounting attachment must conform to known criteria required to sustain harsh weather and hurricane force winds. The integrity of this mounting attachment is important in order to secure the luminaire to the manufacturer's specified tightness and central registration for conformance to predetermined performance and light pattern requirements.

More particularly, as is known in the art, there can be variations from one pipe size to another so that half-inch or larger gaps must be accounted for in the pre-existing pipe mounting diameters, thus the attachment means must seal the excess opening between the luminaire and the pipe from insects, small animals and weather intrusion. In the typical application, electrical wires also pass through the pipe stub to connect within the luminaire after the luminaire is secured to the fitting, creating other mounting and sealing challenges.

Luminaire mounting systems of the prior art have shown several methods to attach to the pipe stub. One type may have a simple pipe flange fitting with setscrews spaced equally apart in at least three positions around the circumference of the coupling to be tightened onto the protruding pipe stub. Another type may have one or more compression clamps internal to the luminaire housing that straddle the pipe to compress it against a saddle-shaped base, which requires removal of or opening of an access door to expose the bolts within the clamp and saddle mechanism. And yet another known mounting system is a docking station concept that allows a plug and socket to be secured to the pipe before the luminaire is mounted in order to ensure that attachment to the pipe stub is correctly meeting specification without the nuisance of holding and balancing the luminaire while tightening all bolts to equal tension.

In the known prior art mounting systems herein described, the installer is generally required to hold the luminaire or luminaire mounting base level and stationary while alternately tightening each of the mounting bolts. As in the case of a luminaire with three or more bolts spread around a flange, they are all behind the luminaire from the position of the installer, and in order to keep the pipe centered within the flange, each bolt must be tightened uniformly from behind the luminaire while the installer holds the luminaire in the correct position with his other hand. In a luminaire that must be opened to access the clamp mechanism, there can typically be four clamp bolts that must be alternately tightened to equal tension in order to keep the pipe centered within the clamp.

Each of these previously described installation scenarios in the exemplary context of outdoor pole lighting is an awkward situation for an installer in a lift or bucket truck and as a result sometimes the installation is completed hastily without properly and evenly securing the mount. The integrity of the mounting attachment is the basis of wind load conformance testing, and is that which secures the luminaire to the pole and pipe stub mount during harsh weather such as hurricane force winds. The inconsistency in mounting integrity is demonstrated in practice with the prior art systems when moderate winds can weaken or remove some luminaires and not others despite wind tunnel test results showing sustainability. Integrity may be further compromised if the clamp forces are not even or centered on the pipe to the manufacturer's recommendations. Luminaire attitude or vertical angle adjustment is affected by the pipe stub position in the clamp method or flange screw methods in each of the aforementioned systems; therefore, when a non-zero angle of luminaire attitude adjustment is set, that can and often does adversely affect installation integrity.

The prior art described above teaches luminaire mounting systems that can be installed in various pipes and pipe stubs, but does not teach an apparatus and method including a single tightening point toward the front of the luminaire and thus facing in the direction of the installer and such a system that inherently closes the pipe against the luminaire regardless of the pipe size so as to prevent the intrusion of insects, small animals and weather. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are generally directed to an internally expanding and locking mechanism that installs inside of the pipe stub of a typical outdoor lighting pole and expands with locking teeth to grasp the inner walls of the pipe mast or stub. An advantage taught by the present invention is the single point tightening method that permits the installer to relatively easily support the luminaire while securing it to the pipe stub or mast in a way that consistently conforms to mounting tension specification and thereby comply with standard wind load testing regardless of the pipe diameter and wall thickness. Another advantage of the present invention is the expansible nature of the mechanism that inherently provides a proper fit and registration to all pipe sizes ordinarily found in the field. Yet another advantage of the present invention is the pipe closure feature of the expanding mechanism that also inherently protects the luminaire from insect and weather intrusion for virtually any of the available pipe sizes, and which also adds further mechanical rigidity to the mounting. While the exemplary embodiment of the invention is shown and described in the context of mounting a luminaire to a conventional outdoor lighting pole, it will be appreciated by those skilled in the art that numerous other mounting applications, both of the pipe or other support and of the device to be mounted, are possible in the present invention without departing from its spirit and scope.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
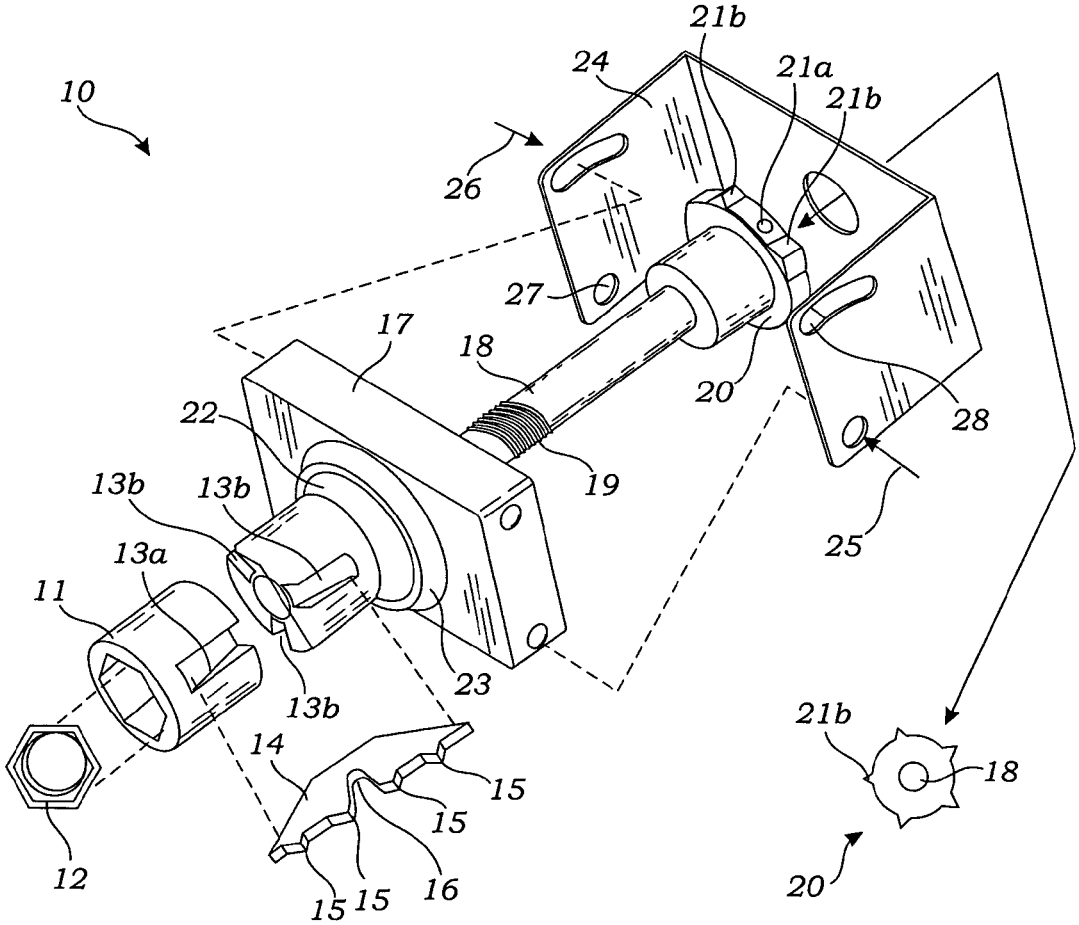
FIG. 1 is an exploded perspective view of an exemplary embodiment of the pipe mounting apparatus of the invention.
Figure 2:
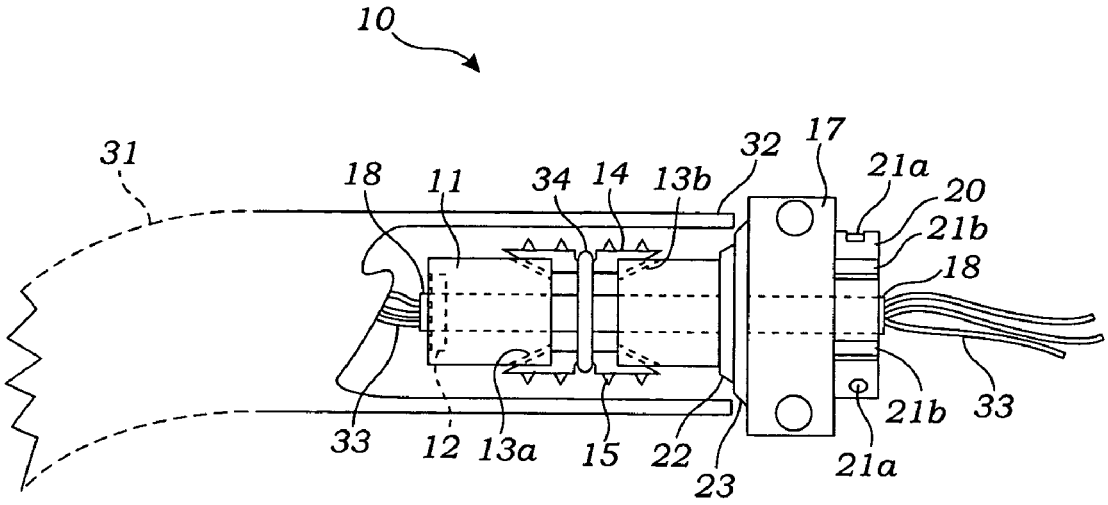
FIG. 2 is a side view thereof showing the pipe mounting apparatus inserted within an exemplary pipe stub.
Figure 3:
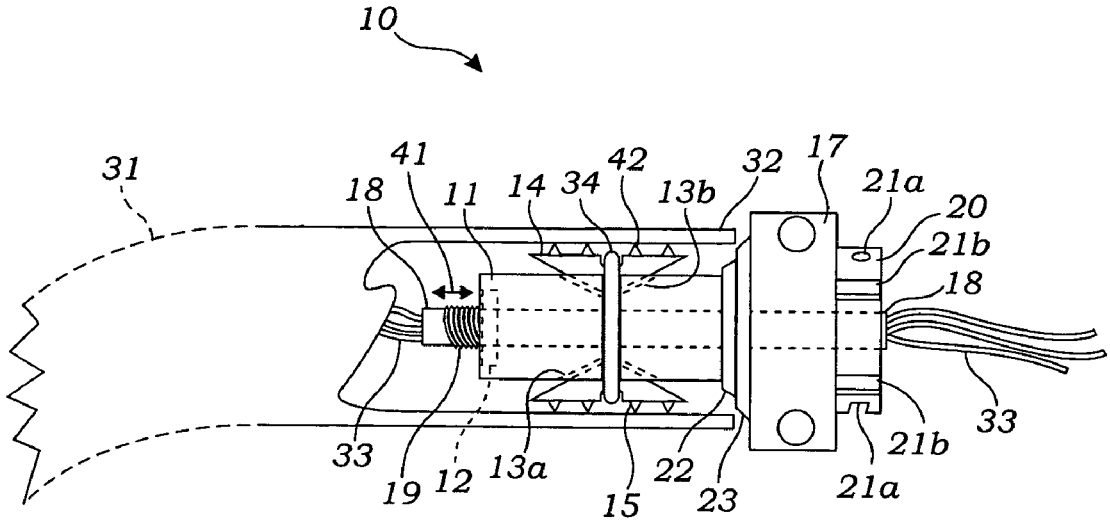
FIG. 3 is a side view thereof showing the pipe mounting apparatus secured within the exemplary pipe stub.

In FIG. 1 there is illustrated an exploded view of an exemplary embodiment of the pipe mounting apparatus 10 of the present invention. The pipe mounting apparatus generally comprises four primary components, including a ramp nut 11 that abuts a swivel base 17 when both have clamp screw 18 inserted through their respective center holes. The assembly of these components is held intact with mounting nut 12 when threaded onto the threads 19 that are cut into the end of the clamp screw 18 opposite the swivel base 17, the mounting nut 12 being seated and keyed within a corresponding recess in the free end of the ramp nut 11. It should be clear to the reader that with the mounting nut 12 so threaded on the clamp screw 18 and secured against rotation by being seated within the ramp nut 11, more or less turning of the clamp screw 18 with its threads 19 engaging the mounting nut 12 will adjust the distance between the ramp nut 11 and the swivel base 17, more about which is said below in connection FIGS. 2 and 3 showing the pipe mounting apparatus 10 in use. Those skilled in the art will appreciate that the size and configuration of the various components making up the pipe mounting apparatus, and hence the apparatus itself, may vary depending on the application, or the particular size or size range of the pipe or other support in or to which the luminaire or other device is to be mounted, such that the components shown and described are to be understood as being merely exemplary and that numerous other sizes and configurations of the pipe mounting apparatus may be practiced without departing from the spirit and scope of the invention. Moreover, again, while the exemplary embodiment of the invention is shown and described in the context of mounting a luminaire to a conventional outdoor lighting pole, it will be appreciated by those skilled in the art that numerous other mounting applications, both of the pipe or other support and of the device to be mounted, are possible in accordance with the principles of the present invention.

In FIG. 1 there are further illustrated grooves 13*a* cut into the ramp nut 11. In the exemplary embodiment there are to be a total of three (3) grooves 13*a*, with two on the rear side not in view, though those skilled in the art will appreciate that the number of such grooves may vary within the scope of the invention. Each groove 13*a* aligns with a similar and opposite groove 13*b* cut into the adjoining swivel base 17. As is also shown in FIG. 1, a trapezoidal or wedge-shaped gripper 14 is configured for insertion within each respective pair of grooves 13*a*, 13*b*. The gripper 14 configuration is illustrated with a plurality of raised bumps or ribs 15 along its front or topside, or its side opposite the ramped or angled edges of the gripper 14 configured to seat in and engage the grooves 13*a*, 13*b* formed in the respective ramp nut 11 and swivel base 17, the raised ribs 15 thus forming serrations therebetween. Also shown is a notch 16 in or about the center of the front or topside edge of the gripper 14. The purpose of the ribs 15 and notch 16 of each gripper 14 will be better understood in the context of FIGS. 2 and 3 illustrating the pipe mounting apparatus 10 in use. Those skilled in the art will once more appreciate that while in the exemplary embodiment there are three such grippers 14 inserted into the corresponding three sets of grooves 13*a*, 13*b*, such that the radially outward mounting forces or points of engagement with the inside surface of a pipe stub or other structure are roughly one hundred twenty degrees (120°) apart, two grippers or more than three grippers of varying geometry, and corresponding grooves in the ramp nut and swivel base, are also possible in the present invention. Specifically, while the exemplary gripper 14 is shown as having four ribs 15 substantially symmetrically arranged in pairs about a single central notch 16, it will be further appreciated that numerous other configurations of the gripper, and its front or topside edge, particularly, to suit a particular application or pipe mount surface are possible without departing from the spirit and scope of the invention.

With continued reference to FIG. 1, there is shown a flange 20 affixed to the clamp screw 18 through which tightening or loosening of the seated mounting nut 12 threadably installed on the clamp screw 18 is affected. One or more holes 21*a* may be incorporated in the flange 20 for inserting a tool to facilitate more leverage in order to increase torque when tightening or loosening the mounting nut 12. In the exemplary embodiment, the flange 20 also has knurled ridges 21*b* or the like to facilitate initial finger tightening without tools, further easing installation. Also shown is a small cone 22 and a large cone 23 affixed to the swivel base 17, which cones will also be better understood in connection with the pipe mounting apparatus 10 in use, as described below and shown in FIGS. 2 and 3.

There is also illustrated in the exemplary pipe mounting apparatus 10 of FIG. 1 a swivel end cap 24 as a means to attach the swivel base 17 to a luminaire (not shown). In the exemplary embodiment, two positions for the upper fasteners 25 and two positions for the lower fasteners 26 are shown to facilitate attachment between the swivel base 17 and the end swivel cap 24. It should be clear to those skilled in the art that the upper fasteners 25 may be configured to enter through round holes 27 so as to offer little or no lateral movement of the swivel end cap 24, while the lower fasteners 26 may be configured to enter through slots 28 in the end swivel cap 24 so as to allow for a range of movement of the swivel end cap 24, the swivel end cap essentially pivoting on the upper fasteners 25 as the lower fasteners 26 ride in slots 28, by which the luminaire (not shown) may be adjusted on at least one axis of movement. As such, it will be appreciated by those skilled in the art that either or both sets of fasteners 25, 26 may utilize slotted mounting holes to achieve some additional or different degree of adjustment of the end swivel cap 24, and hence the luminaire or other such device to be mounted. Likewise, those skilled in the art will also appreciate that when no attitude adjustment of the luminaire or other mounted device is desired, the end cap 24 may be omitted in its entirety and the swivel base 17 may attach directly to such device with fasteners similar to those previously described. It will be appreciate that in any such alternative embodiment, and depending on the application, the fasteners, denoted in FIG. 1 simply by arrows, may include any fastening means now known or later developed, including but not limited to screws, bolts, pins and the like.

Turning now to FIG. 2, there is shown the exemplary embodiment of the pipe mounting apparatus 10 inserted within a pipe stub 31, shown partially cut away. Preferably, the clamp screw 18 is tubular and thus provides a path for the electrical wires 33 originating from within the pole (not shown) and pipe stub 31 to pass through the pipe mounting apparatus 10 and enter the luminaire (not shown) or other device to be mounted and electrically powered. In FIG. 2 it is again shown that the mounting nut 12 is attached to the clamp screw 18 and drawn inside of the corresponding recess formed in the ramp nut 11 that holds the swivel base 17 intact as an assembly. In the view of FIG. 2, now an upper and lower gripper 14 are shown, with a third gripper not shown but present on the hidden side of the ramp nut 11 and swivel base 17. Again, those skilled in the art will appreciate that three grippers 14 is merely illustrative and that the invention is not so limited. As also shown in FIG. 1, each gripper 14 has a notch 16 that in FIG. 2 is shown with an o-ring 34 that holds intact and biases radially inwardly the plurality of grippers 14 that may be incorporated. Those skilled in the art will appreciate that any other mechanical means now known or later developed for holding and/or biasing the two or more grippers 14, including but not limited to a circular coil spring or spring ring clip or any such element having elasticity, may be employed in the present invention to hold the plurality of grippers 14 in place. It will also be appreciated that in an alternative embodiment the mounting nut 12 may be omitted and the ramp nut 11 may itself be threaded to receive the clamp screw.

With continued reference to FIG. 2, it is shown that when the pipe mounting apparatus 10 is inserted into the pipe stub 31, the pipe stub walls 32 substantially abut the flange cone 23, which closes the gap between the pipe wall 32 and the swivel base 17, thereby preventing or minimizing intrusion of any unwanted elements. It will be appreciated that a smaller pipe would abut the smaller flange cone 22, thereby accomplishing end closure for an even smaller pipe. It will thus be appreciated by those skilled in the art that a variety of shapes, configurations and numbers of such flange cones can be adapted for other applications or pipe sizes.

Referring now to FIG. 3, there is now shown the pipe mounting apparatus 10 with the mounting mechanism inside the pipe stub 31. Specifically, the ramp nut 11 has been drawn toward the swivel base 17 by a distance represented by arrow 41, which movement naturally compresses each gripper 14 in its respective grooves 13*a*, 13*b*, thereby raising each gripper 14 on all sides of the ramp nut 11 and the swivel base 17 as each gripper 14 rides substantially radially outwardly as its ramped or angled inside edges engage and slide along the respective groves 13*a*, 13*b*. As shown in FIG. 3, once the mounting nut 12 has been substantially tightened through its travel along the threads 19 of the clamp screw 18 as the screw 18 is rotated by operation of the flange 20, the outwardly projecting ribs 15 formed on the along the outside edge of each gripper 14 now contact the pipe wall 32 substantially in the locations 42. It will be further appreciated that as the clamp screw 18 is tightened, the flange cone 22 or flange cone 23 is drawn closer to the pipe wall 32, thereby further ensuring a seal to the pipe opening and adding yet more mechanical support for the pipe mounting apparatus 10 within the pipe stub 31. It is also apparent from FIG. 3 that the electrical wiring 33 integrity is not compromised during the mounting process, as the wiring 33 is kept a safe distance from any mechanical compression because the clamp screw 18 forms a continuous tubular conduit. Once again, it will be appreciated by those skilled in the art that numerous other configurations of the pipe mounting apparatus and the corresponding means by which it is used are possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A pipe mounting apparatus for mounting a device to a pipe, comprising:

a swivel base having formed therein at least one lengthwise, ramped swivel base groove;

a clamp screw inserted through the swivel base;

a ramp nut passing over the clamp screw so as to be positioned offset from the swivel base, the ramp nut having formed therein at least one lengthwise, oppositely-ramped ramp nut groove configured to be substantially offset from and substantially aligned with the at least one swivel base groove;

a substantially trapezoidal gripper invertedly and slidably inserted within each respective pairing of the swivel base groove and the offset ramp nut groove so as to project substantially radially outwardly; and a mounting nut threadably installed on the clamp screw and configured to engage the ramp nut so as to control the position of the ramp nut relative to the swivel base as the clamp screw is rotated during use of the pipe mounting apparatus, whereby tightening of the clamp screw shifts the ramp nut toward the swivel base and thus shifts each gripper radially outwardly to engage the pipe and secure the pipe mounting apparatus therein.

2. The pipe mounting apparatus of claim 1 comprising:

three swivel base grooves spaced circumferentially about the swivel base approximately one-hundred twenty degrees apart; and three ramp nut grooves spaced circumferentially about the ramp nut approximately one-hundred twenty degrees apart.

3. The pipe mounting apparatus of claim 1 wherein each gripper is formed along a radially-outwardly projecting top edge with one or more raised ribs for engaging the pipe.

4. The pipe mounting apparatus of claim 1 wherein:

at least two swivel base grooves are spaced circumferentially about the swivel base;

at least two corresponding ramp nut grooves are spaced circumferentially about the ramp nut;

at least two grippers are slidably inserted in each respective pair of swivel base grooves and ramp nut grooves; and the pipe mounting apparatus further comprises a means for biasing the grippers substantially radially inwardly.

5. The pipe mounting apparatus of claim 4 wherein:

each gripper is formed along a radially-outwardly projecting top edge with a notch; and the biasing means is selected from the group consisting of an o-ring, a coil spring, and a spring clip, such biasing means being configured to seat in the notches.

6. The pipe mounting apparatus of claim 1 wherein the swivel base is further formed with at least one substantially axial, substantially distally-projecting flange cone configured to engage a stub wall of the pipe, thereby substantially sealing the pipe to minimize intrusion of any unwanted elements and further securing the pipe mounting apparatus within the pipe.

7. The pipe mounting apparatus of claim 6 comprising:

a relatively larger flange cone; and a relatively smaller flange cone adjacent to the larger flange cone.

8. The pipe mounting apparatus of claim 1 wherein a proximal flange is formed on the clamp screw, whereby tightening or loosening of the seated mounting nut threadably installed on the clamp screw is affected through manipulation of the flange.

9. The pipe mounting apparatus of claim 8 wherein holes are formed in the flange for inserting a tool to facilitate increased leverage and torque when tightening or loosening the mounting nut.

10. The pipe mounting apparatus of claim 8 wherein ridges are formed on the flange to facilitate increased leverage and torque when hand-tightening or -loosening the mounting nut.

11. The pipe mounting apparatus of claim 1 further comprising a swivel end cap selectively mounted on the swivel base, the device being mounted on the swivel end cap.

12. The pipe mounting apparatus of claim 11 wherein:

the swivel end cap is formed with at least one hole; and a fastener is inserted through the hole to secure the swivel end cap on the swivel base, thereby securing the device to the pipe mounting apparatus.

13. The pipe mounting apparatus of claim 12 wherein:

the swivel end cap is formed with a pair of offset holes and a pair of offset slots; and a fastener is inserted through each hole and slot to pivot and selectively position the swivel cap relative to the swivel base, thereby securing the device to the pipe mounting apparatus at a desired angle.

14. The pipe mounting apparatus of claim 1 wherein the clamp screw is substantially tubular, whereby electrical wires to the device mounted to the pipe pass through the clamp screw.

15. A pipe mounting apparatus for mounting a device to a pipe, comprising:

a swivel base having formed therein at least one lengthwise, ramped swivel base groove and at least one substantially axial, substantially distally-projecting flange cone configured to engage a stub wall of the pipe;

a tubular clamp screw inserted through the swivel base;

a ramp nut passing over the clamp screw so as to be positioned offset from the swivel base, the ramp nut having formed therein at least one lengthwise, oppositely-ramped ramp nut groove configured to be substantially offset from and substantially aligned with the at least one swivel base groove;

a substantially trapezoidal gripper invertedly and slidably inserted within each respective pairing of the swivel base groove and the offset ramp nut groove so as to project substantially radially outwardly, each gripper being formed along a radially-outwardly projecting top edge with a notch;

an o-ring seated in each notch to bias each gripper substantially radially inwardly; and a mounting nut threadably installed on the clamp screw and configured to engage the ramp nut so as to control the position of the ramp nut relative to the swivel base as the clamp screw is rotated during use of the pipe mounting apparatus, whereby tightening of the clamp screw shifts the ramp nut toward the swivel base and thus shifts each gripper radially outwardly to engage the pipe and secure the pipe mounting apparatus therein, the engagement of the flange cone with the stub wall of the pipe substantially sealing the pipe to minimize intrusion of any unwanted elements and further securing the pipe mounting apparatus within the pipe.

* * * * *